US007940509B2

(12) United States Patent
Orihara et al.

(10) Patent No.: US 7,940,509 B2
(45) Date of Patent: May 10, 2011

(54) IONIZER HAVING MECHANISM FOR CLEANING DISCHARGE ELECTRODES

(75) Inventors: Masayuki Orihara, Tsukubamirai (JP); Takayuki Toshida, Tsukubamirai (JP); Akira Tadano, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 118 days.

(21) Appl. No.: 12/503,195

(22) Filed: Jul. 15, 2009

(65) Prior Publication Data

US 2010/0033891 A1 Feb. 11, 2010

(30) Foreign Application Priority Data

Aug. 7, 2008 (JP) ..... 2008-204689

(51) Int. Cl.
*H01T 23/00* (2006.01)

(52) U.S. Cl. ..... 361/231; 361/230

(58) Field of Classification Search ..... None
See application file for complete search history.

(56) References Cited

U.S. PATENT DOCUMENTS 4,734,580 A * 3/1988 Rodrigo et al. ..... 250/324
5,055,963 A * 10/1991 Partridge ..... 361/231
5,768,087 A * 6/1998 Vernitskiy ..... 361/230
6,137,670 A * 10/2000 West et al. ..... 361/213
2009/0053113 A1* 2/2009 Mai ..... 422/121

FOREIGN PATENT DOCUMENTS

JP 2004-234972 8/2004

OTHER PUBLICATIONS

U.S. Appl. No. 12/410,577, filed Mar. 25, 2009, Orihara et al.
U.S. Appl. No. 12/478,357, filed Jun. 4, 2009, Orihara et al.

* cited by examiner

*Primary Examiner* — Stephen W Jackson
*Assistant Examiner* — Terrence R Willoughby
(74) *Attorney, Agent, or Firm* — Oblon, Spivak, McClelland, Maier & Neustadt, L.L.P.

(57) ABSTRACT

Discharge electrodes for generating ion and a member for cleaning the discharge electrodes are mounted on an electrode support frame, which is detachably attached to the case of an ionizer. When the electrode support frame is attached to the case, the cleaning member occupies a retraction position where the cleaning member does not shut off or disturb air that is supplied from a fan. Upon the detachment of the electrode support frame from the case, the cleaning member becomes moveable. Then, the cleaning member is moved while being brought into contact with the discharging parts of the discharge electrodes one after another. As a result, the cleaning member sweeps dust or other particles off the discharging parts thereof.

10 Claims, 7 Drawing Sheets

IONIZER HAVING MECHANISM FOR CLEANING DISCHARGE ELECTRODES

BACKGROUND OF THE INVENTION

[1] Field of the Invention

The present invention generally relates to an ionizer that is used for diselectrifying a workpiece that is electrified with a positive electric charge or a negative electric charge, that is, an ionizer that is used for the electrical neutralization thereof. In particular, the invention relates to an ionizer having a mechanism for cleaning discharge electrodes that generate positive ions and negative ions by means of corona discharge. An ionizer to which the invention is directed makes it possible for a user to clean such discharge electrodes with the use of a pair of cleaning members, or at least one cleaning member, when they are not clean.

[2] Description of the Related Art

An ionizer that utilizes corona discharge is used in the work-processing steps of various kinds of workpieces such as a semiconductor wafer, a liquid crystal glass, and the like in order to electrically neutralize a workpiece that is charged positively and negatively with static electricity (i.e., destaticization). Ionizers utilizing corona discharge can be roughly classified into direct current (DC) ionizers and alternating current (AC) ionizers. For example, a DC ionizer has positive discharge electrodes and negative discharge electrodes that have a needle-like tip shape. Through the application of a positive high voltage to the positive discharge electrodes and the application of a negative high voltage to the negative discharge electrodes, corona discharge is generated at the discharging part of each of the discharge electrodes, which is the front-end part thereof. Positive ions and negative ions are generated due to the corona discharge. The generated positive and negative ions are blown on a workpiece, which is the target of diselectrification, with the use of a flow of destaticizing air. By this means, the DC ionizer neutralizes a positive electric charge and a negative electric charge on the target workpiece. On the other hand, an AC ionizer applies an alternating voltage to discharge electrodes so that positive ions and negative ions are generated alternately from the discharge electrodes.

In such a typical ionizer of related art, when corona discharge is generated at discharge electrodes, dust particles suspended in the air are attracted to the discharging parts of the discharge electrodes. As dust settles thereon and adheres thereto, the discharging parts of the discharge electrodes become insulated gradually. The gradual insulation of the discharging parts of the discharge electrodes makes it harder to generate corona discharge, which obstructs ion generation. If the generation of ion is obstructed, the diselectrification efficiency of the ionizer decreases. In order to avoid the deterioration of the destaticization performance of the ionizer, it is necessary to clean the discharging parts of discharge electrodes thereof periodically with the use of a cleaning member such as a brush or the like. If a separate cleaning member that does not constitute a part of the ionizer is provided/used for cleaning, a user might forget to keep the cleaning member for the next use, or the cleaning member may be lost.

In order to overcome such a problem, an ionizer that is provided with a cleaning member (brush member) in addition to discharge electrodes and a fan inside the air-blow hole of a case has been proposed in the art as described in Japanese Unexamined Patent Application Publication No. 2004-234972. The ionizer described in Japanese Unexamined Patent Application Publication No. 2004-234972 is provided with a movable member that turns when driven by the flow of air that is supplied from the fan inside the air-blow hole. The cleaning member is mounted on the movable member. When the cleaning member turns together with the movable member, it is brought into contact with the front-end parts of the discharge electrodes one after another. As a result, the cleaning member sweeps dust particles off the front-end parts thereof.

However, the ionizer described in Japanese Unexamined Patent Application Publication No. 2004-234972 has the following disadvantages. Since the movable member and the cleaning member are provided inside the air-blow hole, the movable member and the cleaning member shut off or disturb the flow of air containing ions, which results in a decrease in air-blowing efficiency. In addition, ion recombination occurs due to the mixture of positive ions and negative ions, which is caused by the disturbance of air. If ion recombination occurs, the amount of ion that reaches a diselectrification target workpiece decreases.

Moreover, the ionizer described in the publication identified above has the following disadvantages. Since the cleaning of the discharge electrodes is conducted during the operation of the ionizer, dust particles that have been swept off the discharging parts of the discharge electrodes are scattered by the flow of air. The scattered dust particles could re-adhere to other part of the ionizer. Or, the scattered dust particles could flow out of the ionizer and contaminate a diselectrification environment. Or, the scattered dust particles could be blown to a diselectrification target workpiece and make it unclean.

BRIEF SUMMARY OF INVENTION

An advantage of some aspects of the invention is to provide an ionizer having a member(s) for cleaning discharge electrodes that makes it possible to conduct cleaning without causing the shutoff or disturbance of air that is supplied from a fan because of the presence of the cleaning member. Another advantage of some aspects of the invention is to provide an ionizer having a member(s) for cleaning discharge electrodes that makes it possible to prevent dust or other particles that have been swept off the discharging parts of the discharge electrodes from being scattered by the flow of air, which could otherwise cause the contamination of a diselectrification environment or a diselectrification target workpiece.

In order to overcome the disadvantages explained above without any limitation thereto, the invention provides, as an aspect thereof, an ionizer having a discharge-electrode cleaning mechanism, the ionizer including: a case; an air hole that is formed in the case; a fan that supplies air, the fan being provided inside the air hole; a plurality of discharge electrodes that generates positive ions and negative ions by corona discharge, the plurality of discharge electrodes being provided at positions exposed to and/or facing the air hole in the case; an electrode support flame that is detachably attached to the case with the plurality of discharge electrodes being mounted on the electrode support frame; and a cleaner that is used for cleaning the plurality of discharge electrodes, the cleaner being movably attached to the electrode support frame in such a manner that the cleaner can move from one discharge electrode to another as well as between one discharge electrode and another while being brought into contact with the plurality of discharge electrodes one after another, wherein the cleaner occupies a retraction position that is distanced from the area of the air hole when the electrode support frame is attached to the case; and the cleaner becomes moveable for the purpose of cleaning the plurality of discharge electrodes when the electrode support frame is detached from the case.

In the configuration of an ionizer according to an aspect of the invention described above, it is preferable that the electrode support frame should be made up of a first electrode support frame that is detachably attached at a position corresponding to one half of the air hole and a second electrode support frame that is detachably attached at a position corresponding to the other half of the air hole; and the plurality of discharge electrodes and the cleaner should be provided on each of the first electrode support frame and the second electrode support frame.

In the preferred configuration of an ionizer described above, it is further preferable that each of the first electrode support frame and the second electrode support frame should include a curved part that has the shape of an arc that coincides with a part of the air hole that has the shape of a circle, and should further include a guide that is formed adjacent to the curved part in each of the front face and the rear face of each of the electrode support frames, wherein each discharge electrode is mounted on the curved part of each of the electrode support frames in such a position and orientation that a discharging part of each discharge electrode protrudes in the air hole; wherein the cleaner, which is configured to move freely along the guide of each of the electrode support frames, includes a brush holder that is attached at the curved part of each of the electrode support flames in such a manner that the brush holder sandwiches a part of each of the electrode support frames; a brush that is provided inside the brush holder in such a manner that the brush can be brought into contact with the discharge electrode; and a slider that can slide freely along the guide.

In the preferred configuration of an ionizer described above, it is further preferable that the guide which is formed as a groove, should include a main part that is gently curved along the curved part; and should further include a recess part that extends from one end of the main part in such a manner that the guide is bent at the one end of the main part; wherein the slider is made up of a plurality of sliding projections that fits in the guide so as to be able to slide freely along the guide, the plurality of sliding projections being formed on the inner surface of side plate parts of the brush holder; and when the cleaner is moved to the end of the guide in such a manner that some of the sliding projections is/are fitted in the recess part, the cleaner occupies the retraction position.

In the preferred configuration of an ionizer described above, it is further preferable that the first electrode support frame and the second electrode support frame should have interchangeability so that the electrode support frame can be attached to the case even when the first electrode support frame and the second electrode support frame are replaced with each other.

As a preferred configuration of an ionizer according to an aspect of the invention described above, the case may be provided with a plurality of feeding terminals that is electrically connected to a high voltage source; the electrode support frame may be provided with a plurality of receiving terminals that is electrically connected to the discharge electrodes; and the receiving terminals may become connected to the feeding terminals respectively upon the attachment of the electrode support frame to the case.

As a preferred configuration thereof, an ionizer according to an aspect of the invention described above may include a plurality of pairs of discharge electrodes each of which is made up of a pair of discharge electrodes that generate ion having polarities opposite to each other, wherein a distance from the tip of one of the two discharge electrodes in each pair of discharge electrodes to the center of the air hole is different from a distance from the tip of the other of the two discharge electrodes in each pair of discharge electrodes to the center of the air hole.

In the configuration of an ionizer according to an aspect of the invention described above, the discharge electrodes and the cleaner are provided on the electrode support frame that is detachably attached to the case. The cleaning of the discharge electrodes is conducted with the use of the cleaner after the stopping of the operation of the ionizer and the detaching of the electrode support frame from the case. Therefore, unlike an ionizer of related art, an ionizer according to an aspect of the invention described above makes it possible to prevent dust or other particles that have been swept off the discharging parts of the discharge electrodes from being scattered by the flow of air supplied from the fan, which could otherwise cause the contamination of a diselectrification environment or a diselectrification target workpiece. In addition, since the cleaner occupies (e.g., is set at) a retraction position that is distanced from the area of the air hole when the electrode support frame is attached to the case, unlike an ionizer of related art, an ionizer according to an aspect of the invention described above makes it possible to prevent the cleaner from shutting off or disturbing air that is supplied by and flows from the fan during the operation thereof.

DETAILED DESCRIPTION OF INVENTION

Figure 1:
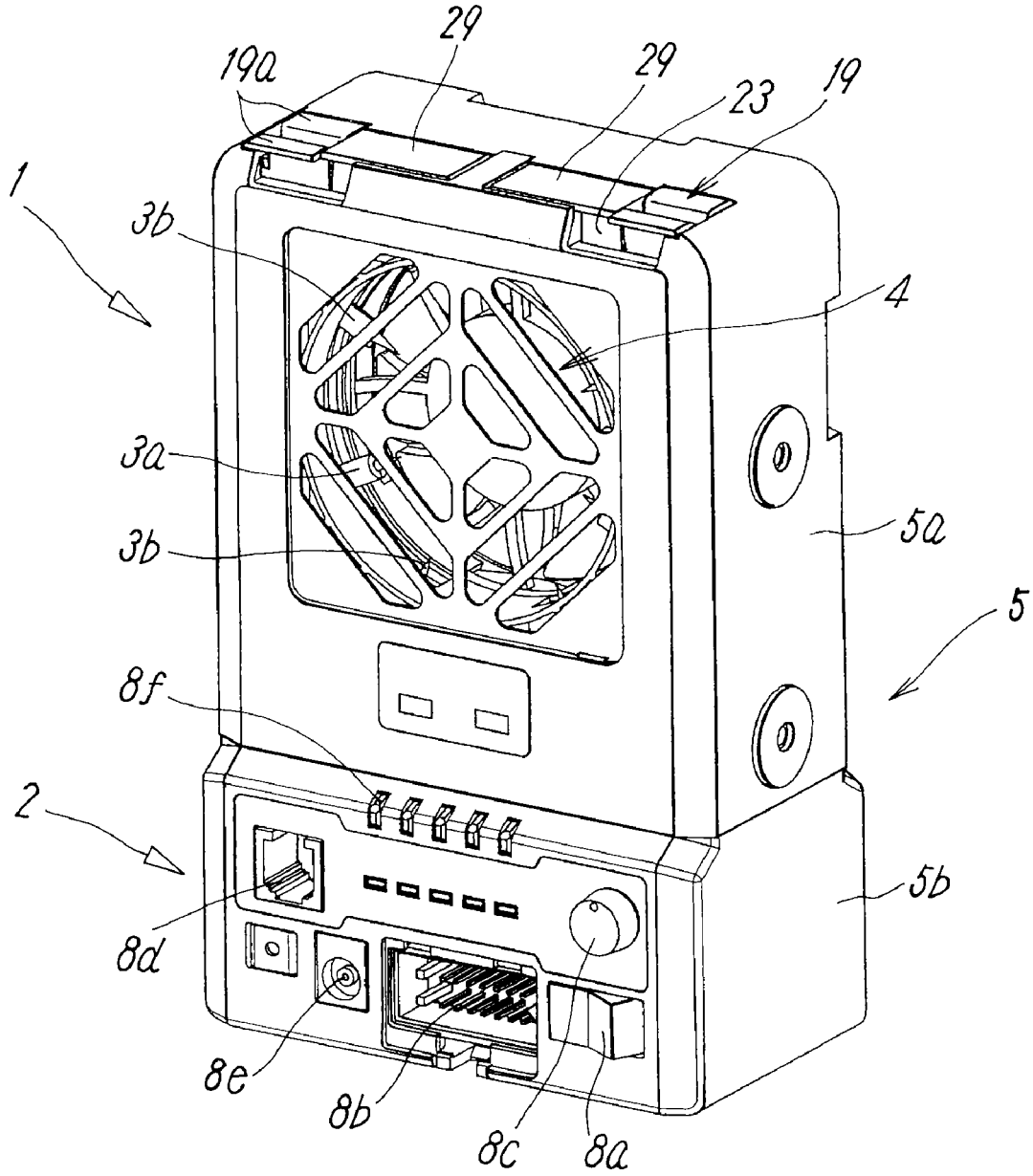
FIG. 1 is a perspective view that schematically illustrates an example of the general appearance of an ionizer according to an embodiment of the invention.

FIGS. 1-4 schematically illustrate an example of the configuration of an ionizer having a mechanism for cleaning discharge electrodes according to an exemplary embodiment of the invention. The ionizer illustrated therein is a direct current (DC) device. Corona discharge is generated when a high-voltage generating device 12*a* and another high-voltage generating device 12*b* apply a positive DC high voltage and a negative DC high voltage to positive discharge electrodes 3*a* and negative discharge electrodes 3*b*, respectively. Positive ions and negative ions are generated due to the corona discharge. An ionizer according to the present embodiment of the invention blows the generated positive and negative ions on a workpiece, which is the target of diselectrification, by generating a flow of destaticizing air with the use of a fan 4. An ionizer according to the present embodiment of the invention is provided with a fan unit 1 that includes the discharge electrodes 3*a* and 3*b* in addition to the fan 4 and is further provided with a control unit 2 that has a built-in controller 7. The built-in controller 7 controls the operation of the high-voltage source devices 12*a* and 12 as well as the operation of the fan 4. The fan unit 1 is provided as the upper unit of the ionizer, which is installed on the lower unit thereof, that is, the control unit 2.

The fan unit 1 includes an upper case 5*a*. The upper case 5*a* has the shape of a rectangular parallelepiped. The upper case 5*a* is made of a synthetic resin. A circular air-blow hole 10 is formed in the upper case 5*a*. The air-blow hole 10 is opened both in the frontward direction through the front body of the fan unit 1 and in the rearward direction through the rear body thereof. A plurality of positive discharge electrodes 3*a* and a plurality of negative discharge electrodes 3*b* are mounted on a discharge electrode support frame 11*a*. In addition, a plurality of positive discharge electrodes 3*a* and a plurality of negative discharge electrodes 3*b* are mounted on another discharge electrode support frame 11*b*. The plurality of positive discharge electrodes 3*a* and the plurality of negative discharge electrodes 3*b* are provided at the inner-circumference part of the air-blow hole 10. The tip of each of the positive/negative discharge electrodes 3*a* and 3*b* is oriented toward the center O of the circular air-blow hole 10. Centering on the position O, the plurality of positive discharge electrodes 3*a* and the plurality of negative discharge electrodes 3*b* are arrayed at predetermined regular circumferential intervals. The fan 4 is provided inside the air-blow hole 10 mentioned above. The fan 4 generates a flow of air. Positive ions generated by the positive discharge electrodes 3*a* and negative ions generated by the negative discharge electrodes 3*b* are blown on a charged workpiece for the diselectrification thereof because of the airflow supplied by the fan 4.

The control unit 2 includes a lower case 5*b*, which is made of a synthetic resin. The built-in controller 7 is encased in the resin-made lower chassis 5*b*. A power switch 8*a*, a wiring connector 8*b*, a rotary switch 8*c*, a modular connector 8*d*, an alternating current (AC) adapter connection jack 8*e*, a status indicator 8*f*, and the like, are provided on the front face of the lower case 5*b*. The wiring connector 8*b* is used for line connection between the control unit 2 and an external power supply device or other external device. The rotary switch 8*c* is used for controlling air volume. The modular connector 8*d* is used for modular connection between the control unit 2 and an external sensor. The status indicator 8*f* indicates the operating state of the ionizer.

In addition to its main function as a controlling device, the control unit 2 functions also as an installation base (i.e., pedestal) when the ionizer is placed at a certain installation site. The dimension of the control unit 2 when viewed in the depth direction is greater than that of the fan unit 1 in the illustrated configuration of an ionizer according to the present embodiment of the invention. Notwithstanding the above, however, the depth of the control unit 2 may be the same as that of the fan unit 1.

Each of the upper case 5*a* of the fan unit 1 and the lower case 5*b* of the control unit 2 constitutes a part of the entire chassis of an ionizer according to the present embodiment of the invention. Therefore, in the following description of this specification, the upper case 5*a* of the fan unit 1 and the lower case 5*b* of the control unit 2 may be collectively referred to as a "case 5". The upper case 5*a* and the lower case 5*b* may be formed as a single case unit such as a single molded unit or the like. Or, the upper case 5*a* and the lower case 5*b* may be formed as two case units separated from each other, which are combined into one case unit thereafter in a detachable manner.

The fan 4 is made up of an electric motor 4*a*, which is provided at the center thereof, and blades 4*b*, which are fixed to the power output shaft of the electric motor 4*a*. The fin 4 is provided inside the air-blow hole 10 concentrically. The electric motor 4*a* of the fan 4 is electrically connected to the built-in controller 7 mentioned above.

The positive high-voltage generating device 12*a* and the negative high-voltage generating device 12*b* are provided inside the fan unit 1. The positive high-voltage generating device 12*a* applies a positive high voltage to the positive discharge electrodes 3*a* mentioned above. The negative high-voltage generating device 12*b* applies a negative high voltage to the negative discharge electrodes 3*b* mentioned above. The positive high-voltage generating device 12*a* and the negative high-voltage generating device 12*b* are electrically connected to the built-in controller 7. In addition, the positive high-voltage generating device 12*a* and the negative high-voltage generating device 12*b* are electrically connected to the positive discharge electrodes 3*a* and the negative discharge electrodes 3*b*, respectively.

Generally speaking, a DC non-pulse ionizer that applies a high voltage continuously at a fixed level and a DC pulse ionizer that applies a pulsed high voltage are known in the art. Either type can be adopted in the present embodiment of the invention.

As a modification example of the configuration explained above, the positive high-voltage generating device 12*a* and the negative high-voltage generating device 12*b* may be provided not inside the fan unit 1 but inside the control unit 2 together with the built-in controller 7. Or, as another modification example thereof, the built-in controller 7 may be provided not inside the control unit 2 but inside the fan unit 1 together with the positive high-voltage generating device 12*a* and the negative high-voltage generating device 12*b*.

One positive discharge electrode 3*a* and one negative discharge electrode 3*b* make a pair of discharge electrodes, which is denoted as 3A or 3B. In the illustrated example of the configuration of an ionizer according to the present embodiment of the invention, four positive discharge electrodes 3*a* and four negative discharge electrodes 3*b* are arrayed alternately. Four pairs of discharge electrodes, or more specifically, two pairs of discharge electrodes 3A and two pairs of discharge electrodes 3B, are provided where each pair of discharge electrodes is made up of one positive discharge electrode 3*a* and one negative discharge electrode 3*b*. These two pairs of discharge electrodes 3A and two pairs of discharge electrodes 3B are arrayed at a predetermined regular distance substantially along the inner circumference of the air-blow hole 10 around the center O thereof.

Each of the positive discharge electrode 3*a* and the negative discharge electrode 3*b* that make up each pair of discharge electrodes 3A, 3B protrudes inside the air-blow hole 10. It should be noted that the length of the protrusion of the positive discharge electrode 3*a* is different from the length of the protrusion of the negative discharge electrode 3*b* in each pair of discharge electrodes 3A, 3B. That is, the electrode length of the positive discharge electrode 3*a* is not the same as the electrode length of the negative discharge electrode 3*b* in each pair of discharge electrodes 3A, 3B. In other words, the distance between the tip of the positive discharge electrode 3*a* and the center O of the air-blow hole 10 is not the same as the distance between the tip of the negative discharge electrode 3*b* and the center O of the air-blow hole 10 in each pair of discharge electrodes 3A, 3B. In the following description of this specification, the distance between the tip of the positive/negative discharge electrode 3*a*, 3*b* and the center O of the air-blow hole 10 may be referred to as a "from-tip-to-center distance" or "between-tip-and-center distance". In such a structure, the relationship between "the distance between the tip of the positive discharge electrode 3*a* and the center O of the air-blow hole 10" and "the distance between the tip of the negative discharge electrode 3*b* and the center O of the air-blow hole 10" in each pair of discharge electrodes 3A, that is, the distance between the tip of the positive discharge electrode 3*a* and the center O of the air-blow hole 10 relative to the distance between the tip of the negative discharge electrode 3*b* and the center O of the air-blow hole 10 or vice versa in each pair of discharge electrodes 3A, is different from the relationship between "the distance between the tip of the positive discharge electrode 3*a* and the center O of the air-blow hole 10" and "the distance between the tip of the negative discharge electrode 3*b* and the center O of the air-blow hole 10" in each pair of discharge electrodes 3B, that is, the distance between the tip of the positive discharge electrode 3*a* and the center O of the air-blow hole 10 relative to the distance between the tip of the negative discharge electrode 3*b* and the center O of the air-blow hole 10 or vice versa in each pair of discharge electrodes 3B. Specifically, the first-type pair of discharge electrodes 3A (i.e., each of two first pairs of discharge electrodes 3A) is made up of one positive discharge electrode 3*a* that has a relatively short electrode length so as to have a relatively long from-tip-to-center distance defined above and one negative discharge electrode 3*b* that has a relatively long electrode length so as to have a relatively short from-tip-to-center distance defined above, whereas the second-type pair of discharge electrodes 3B (i.e., each of two second pairs of discharge electrodes 3B) is made up of one positive discharge electrode 3*a* that has a relatively long electrode length so as to have a relatively short from-tip-to-center distance defined above and one negative discharge electrode 3*b* that has a relatively short electrode length so as to have a relatively long from-tip-to-center distance defined above.

These two first-type pairs of discharge electrodes 3A and two second-type pairs of discharge electrodes 3B are arrayed alternately so as to encircle the center O of the air-blow hole 10 in such a manner that the two first-type pairs of discharge electrodes 3A are provided in an opposite array layout with respect to the center O of the air-blow hole 10 and further that the two second-type pairs of discharge electrodes 3B are also provided in an opposite array layout with respect to the center O of the air-blow hole 10. That is, the two first-type pairs of discharge electrodes 3A are provided opposite to each other with respect to the center O of the air-blow hole 10. In addition, the two second-type pairs of discharge electrodes 3B are provided opposite to each other with respect to the center O of the air-blow hole 10. In such an opposite array layout, an array angle that is formed by each two "adjacent" positive discharge electrodes 3*a* one of which belongs to one of the four pairs of discharge electrodes 3A, 3B (e.g., 3A) and the other of which belongs to another one of the four pairs of discharge electrodes 3A, 3B (e.g., 3B) that is adjacent to the above-mentioned one of the four pairs of discharge electrodes 3A, 3B and not opposite to the above-mentioned one of the four pairs of discharge electrodes 3A, 3B is approximately 90°. In addition, in such an opposite array layout, an array angle that is formed by each two "adjacent" negative discharge electrodes 3*b* one of which belongs to one of the four pairs of discharge electrodes 3A, 3B (e.g., 3A) and the other of which belongs to another one of the four pairs of discharge electrodes 3A, 3B (e.g., 3B) that is adjacent to the above-mentioned one of the four pairs of discharge electrodes 3A, 3B and not opposite to the above-mentioned one of the four pairs of discharge electrodes 3A, 3B is also approximately 90°. In contrast, in each one of the four pairs of discharge electrodes 3A and 3B, an array angle that is formed by the positive discharge electrode 3*a* and the negative discharge electrode 3*b* making up the pail is smaller than 90°.

Figure 5:
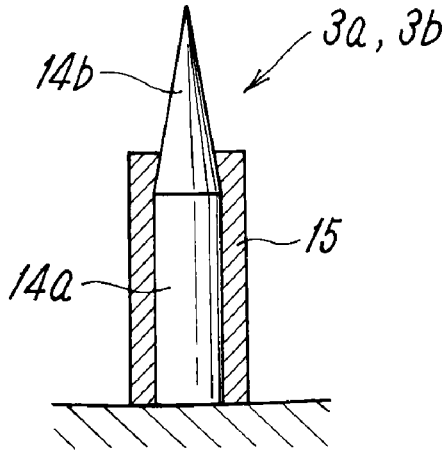
FIG. 5 is a sectional view that schematically illustrates an example of the configuration of the essential parts of a discharge electrode according to an embodiment of the invention.

As illustrated in FIG. 5, the discharge electrode 3*a*, 3*b* includes a body part 14*a* that has the shape of a column and a front-end part 14*b* that has a tapered shape. The front-end part 14*b* of the discharge electrode 3*a*, 3*b* may be hereafter referred to as the tapered part 14*b*. The columnar body part 14*a* of the discharge electrode 3*a*, 3*b* is either covered/coated by an electric insulation material 15 such as a synthetic resin or the like or embedded in the aforementioned discharge electrode support frame 11*a*, 11*b* that is made of a synthetic resin or the like. Therefore, it is only the tapered part 14*b* of the discharge electrode 3*a*, 3*b* that is exposed to the outside. Corona discharge is generated at the exposed tapered part 14*b* of the discharge electrode 3*a*, 3*b*. Positive/negative ions are generated due to the corona discharge. Therefore, the tapered part 14*b* of the discharge electrode 3*a*, 3*b* corresponds to, as a non-limiting example thereof, a "discharging part" according to an aspect of the invention. Accordingly, in the following description of this specification, the reference numeral "14*b*" may be assigned not only to the tapered part 14*b* of the discharge electrode 3*a*, 3*b* but also to a "discharging part" according to an exemplary embodiment of the invention.

The front-end part 14*b* of the discharge electrode 3*a*, 3*b* may have the shape of, for example, a circular cone, which has a pointed tip as the apex thereof. Or, as another example, the tip of the front-end part 14*b* of the discharge electrode 3*a*, 3*b* may be blunted, which has slight roundness.

An electrical insulator covers the discharge electrode 3*a*, 3*b* excluding the discharging part 14*b* thereof. Because of such an insulation-coated structure in which the discharging part 14*b* of the discharge electrode 3*a*, 3*b* only is exposed, even though the positive discharge electrode 3*a* and the negative discharge electrode 3*b* are arrayed in the proximity of each other, a creeping distance from the discharging part 14*b* of the positive discharge electrode 3*a* to the discharging part 14*b* of the adjacent negative discharge electrode 3*b* via the surface of the electric insulation material 15 and the surface of the discharge electrode support frame 11*a*, 11*b* is longer than that of a non-insulation-coated structure in which the discharge electrode 3*a*, 3*b* is not covered by an electrical insulator at all. For this reason, the illustrated structure of the discharge electrode 3*a*, 3*b* makes it possible to lengthen a serviceable time period that ends at a point in time at which dielectric breakdown occurs due to impurities adhering to the discharge electrode, which is attributable to use for a long time and/or use under severe conditions.

Figure 4:
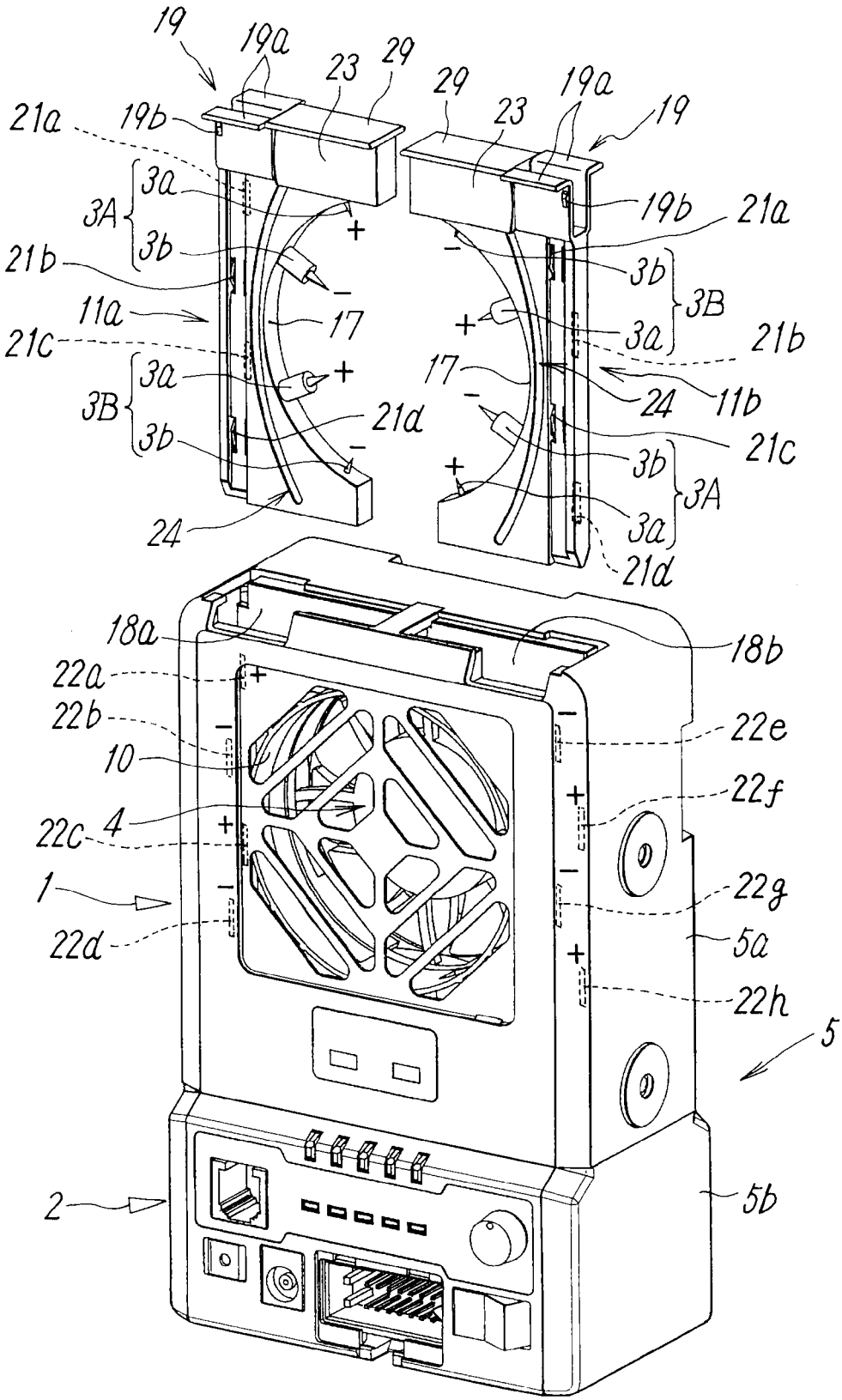
FIG. 4 is a perspective view that schematically illustrates an example of the frame-detached appearance of the ionizer illustrated in FIG. 1, where a pair of discharge electrode support frames is taken out of the ionizer.

As will be understood from FIG. 4, the positive discharge electrodes 3*a* and the negative discharge electrodes 3*b* are mounted on each of the pair of the discharge electrode support frames 11*a* and 11*b*. Each of the discharge electrode support frames 11*a* and 11*b* has the following shape or has a shape that at least resembles one explained below. A frame member that has a quadrangular shape when viewed in plan is vertically split into two frame segments. Each of the middle part at the split side of these two frame segments, which has been separated from the other, is hollowed in the shape of an arc when viewed in plan. The arc is formed along a part of the inner circumference of the air-blow hole 10. The discharge electrode support frames 11*a* and 11*b* have a shape symmetrical to each other. Two pairs of discharge electrodes 3A and 3B are mounted on the curved part 17 of each of the pair of the discharge electrode support frames 11*a* and 11*b*. Specifically, one first-type pair of discharge electrodes 3A and one second-type pair of discharge electrodes 3B are mounted on the curved part 17 of each of the pair of the discharge electrode support frames 11*a* and 11*b*. The positive discharge electrodes 3*a* and the negative discharge electrodes 3*b* are arrayed on the curved part 17 of each of the pair of the discharge electrode support frames 11*a* and 11*b* in such a manner that a discharge electrode that has a relatively short electrode length is provided at each edge-side position of the curved part 17 thereof and that other two discharge electrodes each of which has a relatively long electrode length are provided at two center-side positions of the curved part 17 thereof.

Since the distance between the tip of the positive discharge electrode 3*a* and the center O of the air-blow hole 10 is different from the distance between the tip of the negative discharge electrode 3*b* and the center O of the air-blow hole 10 in each pair of discharge electrodes 3A and 3B, positive ions and negative ions are generated at positions different from each other when viewed in the direction of the radius of the circular air-blow hole 10. For this reason, it is possible to decrease the incidence of ion recombination due to the mixture of positive ions and negative ions that is otherwise caused by the swirling flow of air supplied from the fan 4. Since the ion recombination rate is reduced, it is possible to increase the amount of ion that reaches a diselectrification target workpiece.

Moreover, since both the first-type pair of discharge electrodes 3A and the second-type pair of discharge electrodes 3B are provided on each of the pair of the discharge electrode support frames 11*a* and 11*b*, the distribution of ions in the radial direction of the air-blow hole 10 is made even, which results in an improved ion balance.

The pair of the discharge electrode support frames 11*a* and 11*b* is attached to the aforementioned upper case 5*a* in a detachable manner. Specifically, the pair of the discharge electrode support frames 11*a* and 11*b* is inserted in the upper case 5*a* through a pair of discharge electrode support frame attachment holes 18*a* and 18*b*, which is formed through the upper plate of the upper case 5*a*. The discharge electrode support frames 11*a* and 11*b* are inserted through the discharge electrode support frame attachment holes 18*a* and 18*b*, respectively, in such an orientation that the curved part 17 of the discharge electrode support flame 11*a* and the curved part 17 of the discharge electrode support frame 11*b* face each other. One of the pair of the discharge electrode support frames, the first discharge electrode support frame 11*a*, is detachably attached at a position corresponding to one half of the air-blow hole 10, whereas the other of the pair of the discharge electrode support frames, the second discharge electrode support frame 11*b*, is detachably attached at a position corresponding to the other half of the air-blow hole 10.

The first discharge electrode support frame 11*a* has the same external shape as that of the second discharge electrode support frame 11*b*. In addition, the first discharge electrode support frame 11*a* has the same electrode/terminal/member mounting structure as that of the second discharge electrode support flame 11*b*, including but not limited to, the mounting structure of the discharge electrodes 3*a* and 3*b*, the mounting structure of receiving terminals 21*a*-21*d*, and the mounting structure of cleaning members 23. A more detailed explanation of the receiving terminals 21*a*-21*d* and the cleaning members 23 will be given later. Because of such an identical structure, the first discharge electrode support frame 11*a* and the second discharge electrode support frame 11*b* have interchangeability. That is, the first discharge electrode support frame 11*a* and the second discharge electrode support frame 11*b* may be interchanged with each other and then can be inserted in the discharge electrode support frame attachment holes 18*a* and 18*b* of the upper case 5*a* in a reversed manner.

A lock member 19 is provided at the upper end of each of the pair of the discharge electrode support frames 11*a* and 11*b*. The lock member 19 is made up of a pair of elastic pieces 19*a*. The elastic pieces 19*a* of the lock member 19 can be elastically deformed in an opening/closing manner. Each elastic piece 19*a* of each lock member 19 has a vertical part that extends from the side of the discharge electrode support frame 11*a*, 11*b* in an upward direction and a horizontal part that is bent at a substantially right angle from the upper end of the vertical part and extends horizontally outward. A latch projection 19*b* is formed on the side face of the elastic piece 19*a*. When the discharge electrode support frame 11*a*, 11*b* is inserted in the discharge electrode support frame attachment hole 18*a*, 18*b* of the upper case 5*a*, the latch projection 19*b* of the elastic piece 19*a* is brought into engagement with the upper case 5*a* through the elastic deflection of the elastic piece 19*a*. As a result, the discharge electrode support frame 11*a*, 11*b* is attached to the upper case 5*a*.

When detaching the discharge electrode support frame 11*a*, 11*b* from the upper case 5*a*, a user elastically deforms the pair of elastic pieces 19*a* in a direction that the elastic pieces 19*a* come close to each other so as to disengage the latch projection 19*b* thereof from the upper case 5*a*. Then, the user pulls the discharge electrode support frame 11*a*, 11*b* out of the discharge electrode support frame attachment hole 18*a*, 18*b* of the upper case 5*a* while making the latch projection 19*b* of the elastic piece 19*a* being disengaged from the upper case 5*a*. In this way, the discharge electrode support frame 11*a*, 11*b* can be dismounted from the upper case 5*a*.

Figure 6:
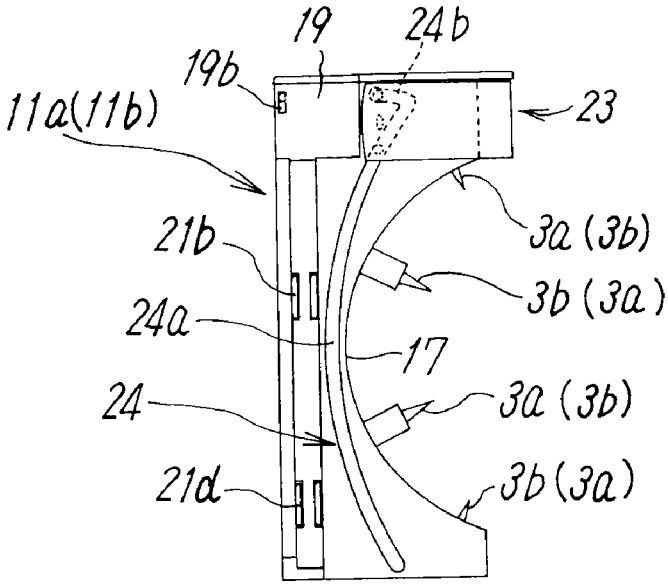
FIG. 6 is a front view that schematically illustrates an example of the configuration of one of the pair of discharge electrode support frames according to an embodiment of the invention.
Figure 7:
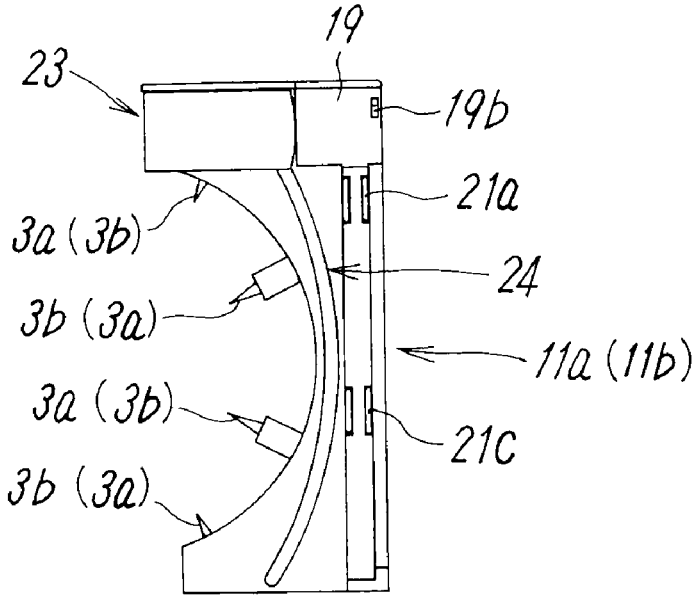
FIG. 7 is a rear view that schematically illustrates an example of the configuration of the discharge electrode support frame illustrated in FIG. 6.

As will be understood from FIGS. 6 and 7, the aforementioned plurality of receiving terminals 21*a*-21*d* are formed on the front/rear faces of each of the pair, of the discharge electrode support frames 11*a* and 11*b* at positions close to the outer side thereof, which is opposite to the curved-part (17) side. Each of the plurality of receiving terminals 21*a*-21*d* provides individual electric connection to the discharge electrode 3*a* or the discharge electrode 3*b*. More specifically, the plurality of receiving terminals 21*a*-21*d* is provided in the following terminal array layout. Two receiving terminals 21*a* and 21*c* are provided on either one of the front/rear faces of each of the pair of the discharge electrode support frames 11*a* and 11*b*, where the face of the discharge electrode support frame 11*a* on which the two receiving terminals 21*a* and 21*c* are provided is not the same as the face of the discharge electrode support frame 11*b* on which the two receiving terminals 21*a* and 21*c* are provided. Each receiving terminal 21*a* is electrically connected to the uppermost discharge electrode 3*a*, 3*b*, which has a relatively short electrode length. Each receiving terminal 21*c* is electrically connected to the third discharge electrode 3*a*, 3*b* from the top, which has a relatively long electrode length. Two receiving terminals 21*b* and 21*d* are provided on the other of the front/rear faces of each of the pair of the discharge electrode support frames 11*a* and 11*b*, where the face of the discharge electrode support frame 11*a* on which the two receiving terminals 21*b* and 21*d* are provided is not the same as the face of the discharge electrode support frame 11*b* on which the two receiving terminals 21*b* and 21*d* are provided. Each receiving terminal 21*b* is electrically connected to the second discharge electrode 3*a*, 3*b* from the top, which has a relatively long electrode length. Each receiving terminal 21*d* is electrically connected to the lowermost discharge electrode 3*a*, 3*b*, which has a relatively short electrode length. These four receiving terminals 21*a*-21*d* are arrayed in a vertical direction on the front/rear faces of each of the pair of the discharge electrode support frames 11*a* and 11*b* at face-reversed symmetrical positions.

Figure 2:
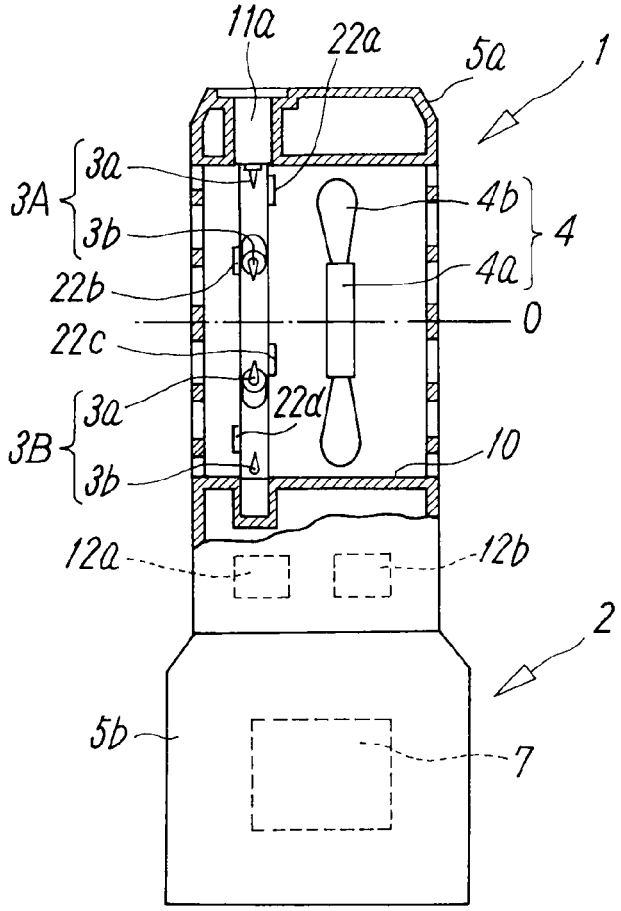
FIG. 2 is a sectional view that schematically illustrates an example of the configuration of the essential parts of the ionizer illustrated in FIG. 1.
Figure 3:
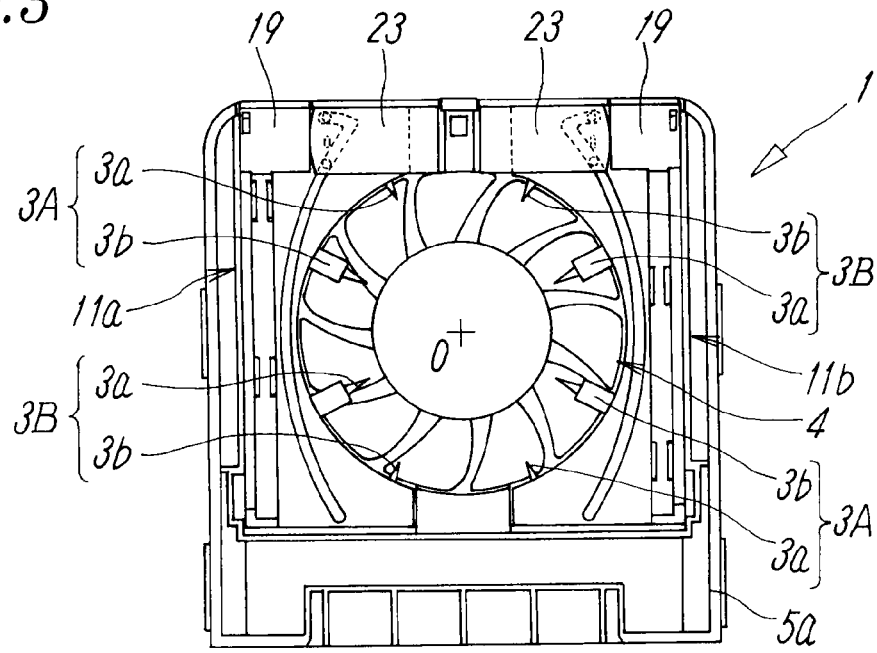
FIG. 3 is a front view that schematically illustrates an example of the inner configuration of the essential parts of a fan unit according to an embodiment of the invention.

On the other hand, as illustrated in FIGS. 2 and 4, four feeding terminals 22*a*-22*d* and four feeding terminals 22*e*-22*h* are provided in the discharge electrode support flame attachment holes 18*a* and 18*b* of the upper case 5*a*, respectively. Four positive feeding terminals 22*a*, 22*c*, 22*f*, and 22*h* are electrically connected to the aforementioned positive high-voltage generating device 12*a*, whereas four negative feeding terminals 22*b*, 22*d*, 22*e*, and 22*g* are electrically connected to the aforementioned negative high-voltage generating device 12*b*. When the pair of the discharge electrode support frames 11*a* and 11*b* is inserted in the pair of the discharge electrode support frame attachment holes 18*a* and 18*b* of the upper case 5*a* for attachment, the receiving terminals 21*a*-21*d* are brought into contact with the feeding terminals 22*a*-22*h*, which establishes electric connection therebetween. As a result, a high voltage of a corresponding polarity is applied to each discharge electrode 3*a*, 3*b*.

In the illustrated example of the configuration of an ionizer according to the present embodiment of the invention, the two positive feeding terminals 22*a* and 22*c*, each of which is electrically connected to the positive high-voltage generating device 12*a*, are provided on the rear inner wall surface of the first discharge electrode support frame attachment hole 18*a* at two vertically different positions with the positive feeding terminal 22*a* being the upper terminal thereof. In addition, the two negative feeding terminals 22*b* and 22*d*, each of which is electrically connected to the negative high-voltage generating device 12*b*, are provided on the front inner wall surface of the first discharge electrode support frame attachment hole 18*a* at two vertically different positions with the negative feeding terminal 22*b* being the upper terminal thereof. The two positive feeding terminals 22*f* and 22*h*, each of which is electrically connected to the positive high-voltage generating device 12*a*, are provided on the rear inner wall surface of the second discharge electrode support frame attachment hole 18*b* at two vertically different positions with the positive feeding terminal 22*f* being the upper terminal thereof. In addition, the two negative feeding terminals 22*e* and 22*g*, each of which is electrically connected to the negative high-voltage generating device 12*b*, are provided on the front inner wall surface of the second discharge electrode support frame attachment hole 18*b* at two vertically different positions with the negative feeding terminal 22*e* being the upper terminal thereof.

Since an ionizer according to the present embodiment of the invention has the terminal arrangement explained above, when the first discharge electrode support frame 11*a* is inserted in the first discharge electrode support frame attachment hole 18*a* for attachment, the two receiving terminals 21*a* and 21*c* of the first discharge electrode support frame 11*a* become electrically connected to the two positive feeding terminals 22*a* and 22*c* of the first discharge electrode support frame attachment hole 18*a*, respectively; in addition, the two receiving terminals 21*b* and 21*d* of the first discharge electrode support frame 11*a* become electrically connected to the two negative feeding terminals 22*b* and 22*d* of the first discharge electrode support frame attachment hole 18*a*, respectively. On the other hand, when the second discharge electrode support frame 11*b* is inserted in the second discharge electrode support frame attachment hole 18*b* for attachment, the two receiving terminals 21*a* and 21*c* of the second discharge electrode support frame 11*b* become electrically connected to the two negative feeding terminals 22*e* and 22*g* of the second discharge electrode support frame attachment hole 18*h*, respectively; in addition, the two receiving terminals 21*b* and 21*d* of the second discharge electrode support frame 11*b* become electrically connected to the two positive feeding terminals 22*f* and 22*h* of the second discharge electrode support frame attachment hole 18*b*, respectively. Therefore, the polarity of a high voltage that is applied to each of the discharge electrodes 3*a* and 3*b* of the discharge electrode support frames 11*a* and 11*b* is as illustrated in FIG. 4.

The polarity of each of the discharge electrodes 3*a* and 3*b* of the discharge electrode support frames 11*a* and 11*b* becomes reversed if the first discharge electrode support frame 11*a* and the second discharge electrode support frame 11*b* are replaced with each other while reversing each of the face orientation of the first discharge electrode support frame 11*a* and the second discharge electrode support frame 11*b* so that the front face thereof becomes the rear face thereof. That is, if the first discharge electrode support frame 11*a* is inserted in the second discharge electrode support frame attachment hole 18*b* after the interchanging and reversing explained above, which means that the second discharge electrode support frame 11*b* is inserted in the first discharge electrode support frame attachment hole 18*a*, the polarity of each of the discharge electrodes 3*a* and 3*b* of the discharge electrode support frames 11*a* and 11*b* becomes reversed. When interchanged and reversed as explained above, the reference signs 11*a* and 11*b* are reversed in FIG. 4.

Generally speaking it is known in the art that the degree of wear and tear of a positive discharge electrode is not the same as that of a negative electrode when corona discharge is generated at the discharge electrodes. In view of the above, as has already been explained earlier, the first discharge electrode support frame 11*a* and the second discharge electrode support frame 11*b* according to the present embodiment of the invention have interchangeability, which allows the first discharge electrode support frame 11*a* and the second discharge electrode support frame 11*b* to be replaced with each other periodically so that the polarity of the discharge electrodes 3*a* and 3*b* is switched over between positive and negative. The periodic polarity reversal makes it possible to equalize the degree of wear and tear between the discharge electrodes 3*a* and 3*b*. For this reason, it is possible to extend the total serviceable time period thereof.

The aforementioned cleaning member 23, which is used for cleaning the discharge electrodes 3*a* and 3*b*, is moveably attached to each of the pair of the discharge electrode support frames 11*a* and 11*b*. Each of the discharge electrode support frames 11*a* and 11*b* has a guide 24. The cleaning member 23 is attached to each discharge electrode support frame 11*a*, 11*b* in such a manner that it can be slid along the guide 24.

The cleaning member 23 includes a brush holder 25, a brush 26, and a slider 27. As will be understood from FIGS. 4, 9, and 10, the cleaning member 23 has the following structure. The brush holder 25 has a grooved body in a sectional view.

The brush holder 25 is moveably attached to the discharge electrode support frame 11*a*, 11*b* at the aforementioned curved-part (17) side thereof. The grooved brush holder 25 sandwiches a part of the discharge electrode support frame 11*a*, 11*b* at each movement position. The brush 26 is provided inside the grooved brush holder 25 in such a manner that it can be brought into contact with the discharge electrode 3*a*, 3*b*. The slider 27 is provided at the base end of the brush holder 25. The slider 27 is in engagement with the guide 24. Since the slider 27 can move along the guide 24, the cleaning member 23 can be slid thereon.

The brush holder 25 is made of an electric insulation material such as a synthetic resin or the like. The brush holder 25 includes a left side plate part 25*a*, a right side plate part 25*a*, and a connection end plate part 25*b*. The end plate part 25*b* is formed as the bottom part of the groove at the front end, that is, the end opposite to the base end, of each of the left/right side plate parts 25*a*. The brush 26 is provided on the inner surface of the end plate part 25*b* of the brush holder 25. The brushing end of the brush 26 is directed toward the base end of the brush holder 25. At the time when the cleaning member 23 passes through the mount position of the discharge electrode 3*a*, 3*b*, the brush 26 is brought into contact with the front-end part 14*b* of the discharge electrode 3*a*, 3*b*, that is, the discharging part 14*b* thereof. As a result, the brush 26 sweeps dust or other particles off the discharging part 14*b* thereof. The brush 26 is fixed to a brush base 26*a*. The brush base 26*a* is attached to the inner surface of the end plate part 25*b* of the brush holder 25. The brush base 26*a* may be provided as a detachable member.

The guide 24 is provided as an arc groove that is formed adjacent to the curved part 17 in each of the front surface and the rear surface of each of the pair of the discharge electrode support frames 11*a* and 11*b*. The guide 24 includes a main guiding rail part 24*a* and a recess part 24*b*. The main guiding rail part 24*a* of the guide 24 extends roughly along the curved part 17. The recess part 24*b*, which does not constitute a part of the arc, extends from one end, specifically, the upper end, of the main guiding rail part 24*a*. The recess part 24*b* extends away from the curved part 17. Since the recess part 24*b* extends from the upper end of the main guiding rail part 24*a* in a direction that is roughly opposite to a direction toward the curved part 17 whereas the main guiding rail part 24*a* extends roughly along the curved part 17 so as to form the arc, the guide 24 is bent it an acute angle at the point of a juncture therebetween, that is, at the upper end mentioned above.

The radius of curvature of the main guiding rail part 24*a* of the guide 24 is larger than that of the curved part 17 of the discharge electrode support frame 11*a*, 11*b*. In addition, the center of curvature of the main guiding rail part 24*a* lies at a position different from the center of curvature of the curved part 17, or more specifically, at a position on the extension of the radius of curvature of the curved part 17. Therefore, the distance between the main guiding rail part 24*a* and the curved part 17 is the shortest substantially at the center of the curved part 17. The distance between the main guiding rail part 24*a* and the curved part 17 increases toward each edge of the curved part 17. For this reason, when measured along the length of the brush holder 25, the distance from the main guiding rail part 24*a* of the guide 24 to the discharging part 14*b* of the shorter electrode-length discharge electrode 3*a*, 3*b*, which is provided at each edge-side position of the curved part 17, is substantially equal to the distance from the main guiding rail part 24*a* of the guide 24 to the discharging part 14*b* of the longer electrode-length discharge electrode 3*a*, 3*b*, which is provided at each center-side position of the curved part 17. Thus, it is possible to clean, by means of the brush 26 of the cleaning member 23 with reliable cleaning performance, the discharging part 14*b* of each of the discharge electrodes 3*a* and 3*b* although some of them have a relatively short electrode length and the others have a relatively long electrode length.

Figure 8:
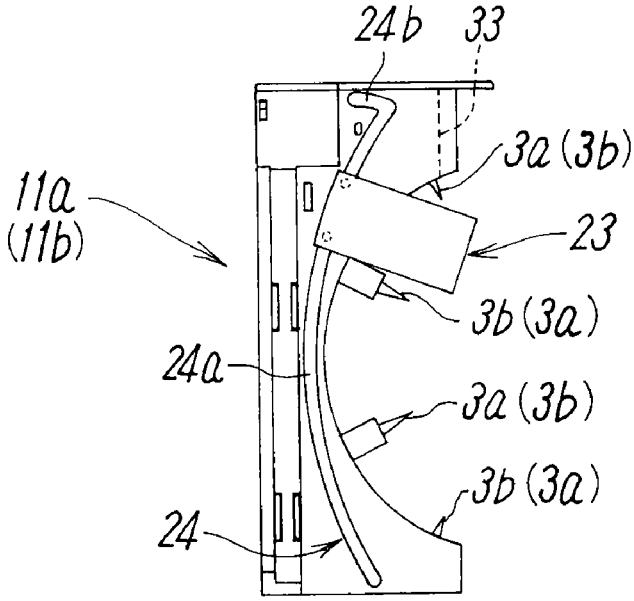
FIG. 8 is a front view that schematically illustrates an example of the cleaning of the discharge electrodes with the use of the cleaning member according to an embodiment of the invention.
Figure 9:
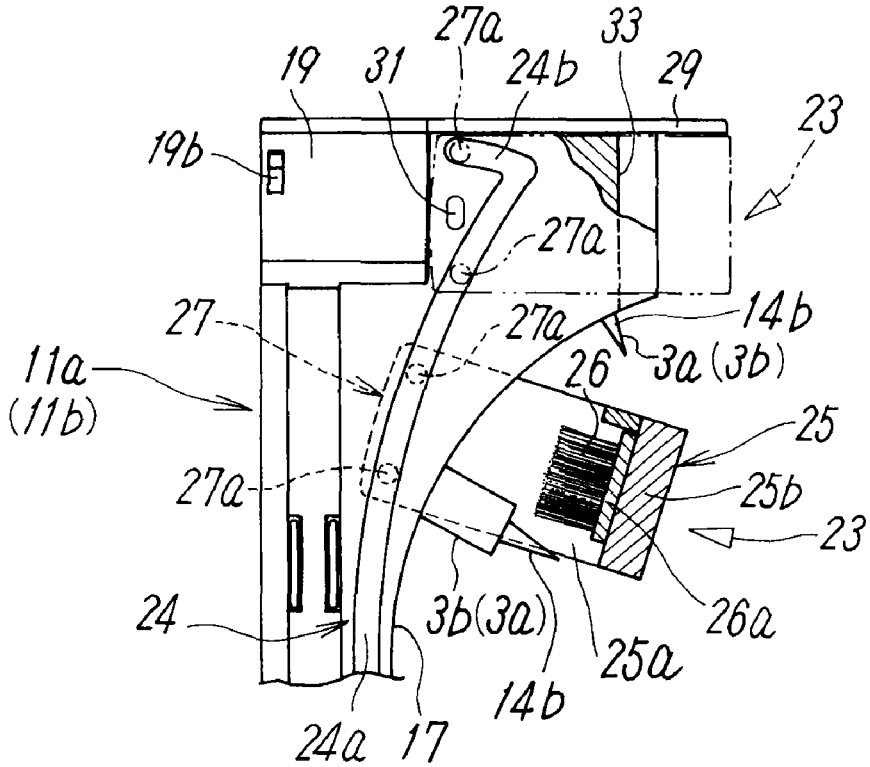
FIG. 9 is an enlarged view that schematically illustrates an example of the configuration of essential parts illustrated in FIG. 8.
Figure 10:
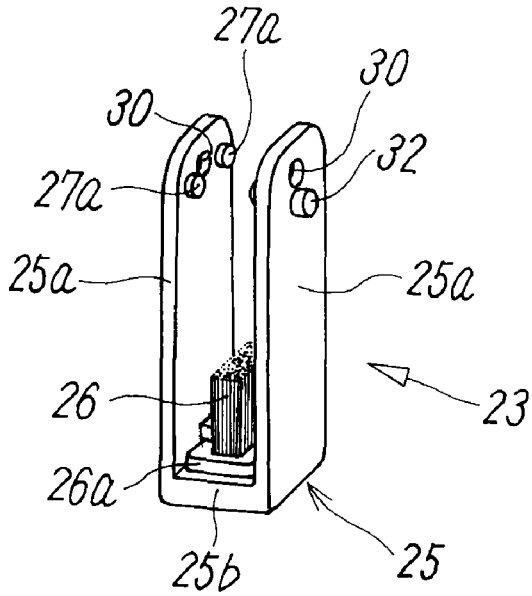
FIG. 10 is a perspective view that schematically illustrates an example of the configuration of the cleaning member according to an embodiment of the invention.

The slider 27 is made up of a plurality of sliding projections 27*a* that is formed on the inner surface of the left/right side plate parts 25*a* of the brush holder 25. Two sliding projections 27*a* are formed on the inner surface of each side plate part 25*a* of the brush holder 25. These two sliding projections 27*a* are fitted in a groove that constitutes the guide 24 in each surface. At the time when the discharge electrodes 3*a* and 3*b* are cleaned with the use of the cleaning member 23, as illustrated in FIGS. 8 and 9, the sliding projections 27*a* of the cleaning member 23 ale slid along the main guiding rail part 24*a* of the guide 24 while being in engagement with the main guiding rail part 24*a*. At the time when the cleaning member 23 is not used for cleaning the discharge electrodes 3*a* and 3*b*, as indicated with a chain double-dashed line in FIG. 9, the upper one of the two sliding projections 27*a* of the cleaning member 23 is fitted into the retraction end of the recess part 24*b* so that the cleaning member 23 is moved to and held at its non-cleaning retraction position.

When the cleaning member 23 has been retracted to its non-cleaning position, it is oriented in a direction parallel to the top of the discharge electrode support frame 11*a*, 11*b*. In addition, when the cleaning member 23 is set at the non-cleaning retraction position, it is in contact with the lower surface of an eave frame 29 that is fixed to the upper end of the discharge electrode support frame 11*a*, 11*b*. Each of the pair of the discharge electrode support frames 11*a* and 11*b* is attached to the upper case 5*a* with the cleaning member 23 being set at the non-cleaning retraction position. When the cleaning member 23 is set at the non-cleaning retraction position, it is distanced from the flowing path of air that is supplied from the fan 4 in the air-blow hole 10. Therefore, in no case is ail that flows in the air-blow hole 10 shut off or disturbed by the cleaning member 23.

A latch hole 30 is formed through each of the left/right side plate parts 25*a* of the brush holder 25. On the other hand, a latch projection 31 is formed on each of the pair of the discharge electrode support frames 11*a* and 11*b*. When the cleaning member 23 is set at the non-cleaning retraction position, the latch projection 31 fits in the latch hole 30 so that the cleaning member 23 is held thereat.

In addition, a lock projection 32 is formed on the outer surface of each of the left/right side plate parts 25*a*. When the discharge electrode support frame 11*a*, 11*b* is attached to the upper case 5*a*, the lock projection 32 is brought into locking engagement with a part of the upper case 5*a*, which prevents the cleaning member 23 from moving to a cleaning position when it is not supposed to.

The reference numeral 33 shown in FIG. 9 denotes a concavity that is formed in the curved-part (17) end face of the discharge electrode support frame 11*a*, 11*b*. When the cleaning member 23 is set at the non-cleaning retraction position, the brushing-end part of the brush 26 fits in the concavity 33.

When the cleaning of the discharge electrodes 3*a* and 3*b* of an ionizer according to the present embodiment of the invention, which has the configuration explained above, is conducted, as a first step, the operation of the ionizer is stopped. Then, the pair of the discharge electrode support frames 11*a* and 11*b* is detached from the upper case 5*a* as illustrated in FIG. 4. Next, as illustrated in FIGS. 8 and 9, the cleaning member 23 that is set at the non-cleaning retraction position is moved to an on-the-arc position so that the cleaning member 23 can be slid along the guide 24. Then, the cleaning member 23 is moved along the main guiding rail part 24*a* of the guide 24 in reciprocatory motion. The cleaning member 23 may be slid back and forth along the main guiding rail part 24*a* of the guide 24 just once. Or, the cleaning member 23 may be reciprocated along the main guiding rail part 24*a* of the guide 24 twice or more. During the reciprocatory sliding of the cleaning member 23, it moves from one discharge electrode 3*a*, 3*b* to another as well as between one discharge electrode 3*a*, 3*b* and another while changing its position and orientation gradually with the body thereof projecting in the airflow area of the air-blow hole 10 when viewed from the curved part 17. When the cleaning member 23 is slid through the discharge electrodes 3*a* and 3*b* one after another, the brush 26 of the cleaning member 23 is brought into contact with the discharging parts 14*b* of the discharge electrodes 3*a* and 3*b* in a sequential manner. As a result, the brush 26 sweeps dust or other particles off the discharging parts 14*b* thereof one after another.

If the cleaning of the unclean discharge electrodes 3*a* and 3*b* of the ionizer is conducted after, as a first step, the operation of the ionizer has been stopped, and then, the pair of the discharge electrode support frames 11*a* and 11*b* has been detached from the upper case 5*a* as explained above, it is possible to prevent any dust or other particles swept off the discharging parts 14*b* of the discharge electrodes 3*a* and 3*b* from being scattered by the flow of air. In the operation of an ionizer of related art, scattered dust or other particles could re-adhere to other part of the ionizer. Or, the scattered dust or other particles could flow out of the ionizer and contaminate a diselectrification environment. Or, the scattered dust or other particles could be blown to a diselectrification target workpiece and make it unclean. These problems of related art can be overcome by cleaning the discharge electrodes 3*a* and 3*b* of the ionizer after the stopping of the operation of the ionizer and the removal of the pair of the discharge electrode support frames 11*a* and 11*b* from the upper case 5*a*.

When the cleaning of the discharge electrodes 3*a* and 3*b* has been completed, a user moves the cleaning member 23 back to the upper end of the guide 24 so as to fit the upper one of the two sliding projections 27*a* thereof into the retraction end of the recess part 24*b*. In such a positional state, the cleaning member 23 occupies the non-cleaning retraction position that is distanced from the airflow area of the air-blow hole 10. The operation of the ionizer becomes possible by attaching the pair of the discharge electrode support frames 11*a* and 11*b* to the upper case 5*a* with the cleaning member 23 being set at the non-cleaning retraction position. When the ionizer is operated, since the cleaning member 23 is set at the non-cleaning retraction position that is distanced from the airflow area of the air-blow hole 10, in no case is the flow of air that is supplied by the fin 4 shut off or disturbed by the cleaning member 23. For this reason, an ionizer according to the present embodiment of the invention makes it possible to overcome the disadvantages of an ionizer of related art in a reliable manner, including but not limited to, decreased air-blowing efficiency, or the occurrence of ion recombination due to the mixture of positive ions and negative ions that is caused by the swirling flow of air, which results in a decrease in the amount of ion that reaches a diselectrification target workpiece.

The aforementioned eave frame 29 that is fixed to the upper end of the discharge electrode support frame 11*a*, 11*b* functions as a position determination member that determines the non-cleaning retraction position of the cleaning member 23. In addition to the position determination function, the eave frame 29 has another function of covering the open upper end of the discharge electrode support frame attachment hole 18*a*, 18*b* when the discharge electrode support frame 11*a*, 11*b* is inserted in the discharge electrode support frame attachment hole 18*a*, 18*b* of the upper case 5*a* for attachment.

Figure 11:
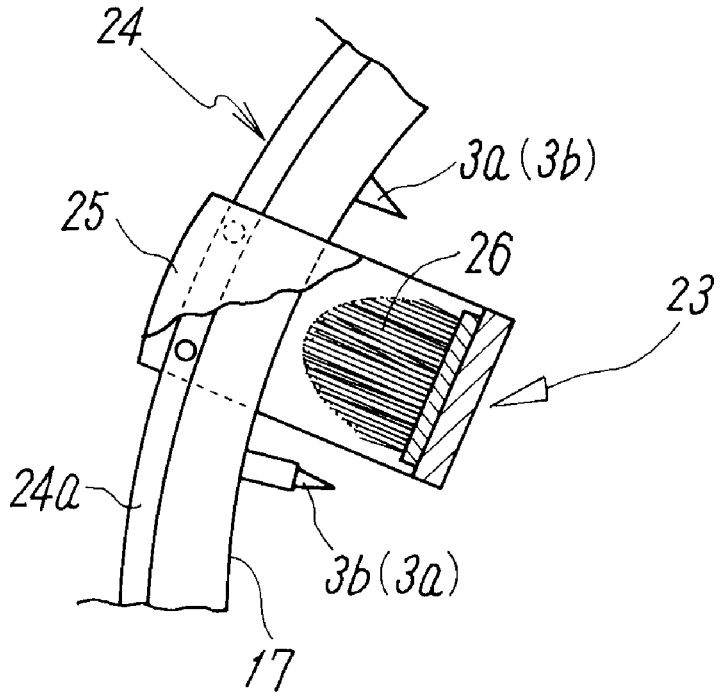
FIG. 11 is a partial sectional view that schematically illustrates another example of the configuration of the cleaning member according to an embodiment of the invention.

In the foregoing description of an example of the configuration of an ionizer according to in exemplary embodiment of the invention, the brush 26 of the cleaning member 23 is made of fibers having a certain uniform length so that the brushing end of the brush 26 forms a single flat plane. Notwithstanding the foregoing, however, the brushing end of the brush 26 may be formed as, for example, a rounded convex as illustrated in FIG. 11. If the brushing end of the brush 26 forms such a curved face, the rounded brushing face of the brush 26 can be brought into contact with various parts of the discharge electrodes 3*a* and 3*b*. Therefore, the cleaning capability of the brush 26 is improved. In addition, if the electrode length of the positive discharge electrode 3*a* is not so different from that of the negative discharge electrode 3*b*, the rounded convex configuration of the brush 26 explained above makes it possible to form the main guiding rail part 24*a* of the guide 24 as an arc that is concentric with the arc of the curved part 17 of the discharge electrode support frame 11*a*, 11*b*.

In the illustrated configuration of an ionizer according to an exemplary embodiment of the invention, two pairs of discharge electrodes 3A and 3B, that is, one first-type pair of discharge electrodes 3A and one second-type pair of discharge electrodes 3B, are mounted on the curved part 17 of each of the pair of the discharge electrode support frames 11*a* and 11*b*. However, the scope of this aspect of the invention is not limited to such an exemplary configuration. For example, only one pair of discharge electrodes 3A, 3B may be mounted on the curved part 17 of the discharge electrode support frame 11*a*, 11*b*. Or, as another modification example, three pairs or more of discharge electrodes 3A, 3B may be mounted on the curved part 17 of the discharge electrode support frame 11*a*, 11*b*.

In the foregoing description of an exemplary embodiment of the invention, an ionizer is provided with the pair of the discharge electrode support frames 11*a* and 11*b* that is separated from each other. Notwithstanding the foregoing, however, as a modification example thereof, the discharge electrode support frames 11*a* and 11*b* may be formed into a single discharge electrode support frame. That is, an ionizer may be provided with only one non-split discharge electrode support frame. In such a modified configuration, the ionizer may be provided with a pair of cleaning members 23 one of which is used for the cleaning of discharge electrodes mounted on one half of the single discharge electrode support flame and the other of which is used for the cleaning of discharge electrodes mounted on the other half of the single discharge electrode support frame. Or, the ionizer may be provided with only one cleaning member 23 that is configured to be capable of moving along the entire circumference of the air-blow hole 10.

It is not always necessary that the electrode length of the positive discharge electrode 3*a* should be different from the electrode length of the negative discharge electrode 3*b* in each pair of discharge electrodes 3A, 3B. In other words, it is not always necessary that the between-tip-and-center distance of the positive discharge electrode 3*a* defined earlier should be different from the between-tip-and-center distance of the negative discharge electrode 3*b* defined earlier in each pair of discharge electrodes 3A, 3B. If it is not so necessary to take measures against the problem of ion recombination due to the mixture of positive ions and negative ions, the electrode length of the positive discharge electrode 3*a* may be the same as the electrode length of the negative discharge electrode 3*b* in each pair of discharge electrodes 3A, 3B. In such a modified configuration, the main guiding rail part 24*a* of the guide 24 is formed as an arc that is concentric with the arc of the curved part 17.

An ionizer according to the foregoing exemplary embodiment of the invention is explained as a DC device. Notwithstanding the foregoing, however, the invention may be applied to an AC ionizer. When the invention is applied to an AC ionizer, an AC high voltage is applied to two discharge electrode 3*a* and 3*b* that make up each pair of discharge electrodes 3A, 3B at such timing that the polarity of the discharge electrode 3*a* and the polarity of the discharge electrode 3*b* are opposite to each other.

What is claimed is:

1. An ionizer having a discharge-electrode cleaning mechanism, the ionizer comprising:

a case;

an air hole formed in the case;

a fan that supplies air, the fan being provided inside the air hole;

a plurality of discharge electrodes that generates positive ions and negative ions by corona discharge, the plurality of discharge electrodes being provided at positions exposed to and/or facing the air hole in the case;

an electrode support frame that is detachably attached to the case with the plurality of discharge electrodes being mounted on the electrode support frame; and a cleaner for cleaning the plurality of discharge electrodes, the cleaner moveably attached to the electrode support frame in such a manner that the cleaner can move from one discharge electrode to another as well as between one discharge electrode and another while being brought into contact with the plurality of discharge electrodes one after another, wherein the cleaner occupies a retraction position that is distanced from the area of the air hole when the electrode support frame is attached to the case; and the cleaner becomes moveable for the purpose of cleaning the plurality of discharge electrodes when the electrode support frame is detached from the case.

2. The ionizer according to claim 1, wherein the electrode support frame is made up of a first electrode support frame that is detachably attached at a position corresponding to one half of the air hole and a second electrode support frame that is detachably attached at a position corresponding to the other half of the air hole; and the plurality of discharge electrodes and the cleaner are provided on each of the first electrode support frame and the second electrode support frame.

3. The ionizer according to claim 2, wherein each of the first electrode support frame and the second electrode support frame includes a curved part that has the shape of an arc that coincides with a part of the air hole that has the shape of a circle, and a guide that is formed adjacent to the curved part in each of the front face and the rear face of each of the electrode support frames, wherein each discharge electrode is mounted on the curved part of each of the electrode support frames in such a position and orientation that a discharging part of each discharge electrode protrudes in the air hole;

wherein the cleaner, which is configured to move freely along the guide of each of the electrode support frames, includes a brush holder that is attached at the curved part of each of the electrode support frames in such a manner that the brush holder sandwiches a part of each of the electrode support frames;

a brush that is provided inside the brush holder in such a manner that the brush can be brought into contact with the discharge electrode; and a slider that can slide freely along the guide.

4. The ionizer according to claim 3, wherein the guide, which is formed as a groove, includes a main part that is gently curved along the curved part; and a recess part that extends from one end of the main part in such a manner that the guide is bent at the one end of the main part;

wherein the slider is made up of a plurality of sliding projections that fits in the guide so as to be able to slide freely along the guide, the plurality of sliding projections being formed on the inner surface of side plate parts of the brush holder; and when the cleaner is moved to the end of the guide in such a manner that some of the sliding projections is/are fitted in the recess part, the cleaner occupies the retraction position.

5. The ionizer according to claim 2, wherein the first electrode support frame and the second electrode support flame have interchangeability so that the electrode support frame can be used even when the first electrode support frame and the second electrode support frame are replaced with each other.

6. The ionizer according to claim 3, wherein the first electrode support frame and the second electrode support frame have interchangeability so that the electrode support frame can be used even when the first electrode support frame and the second electrode support frame are replaced with each other.

7. The ionizer according to claim 1, wherein the case is provided with a plurality of feeding terminals that is electrically connected to a high voltage source;

the electrode support frame is provided with a plurality of receiving terminals that is electrically connected to the discharge electrodes; and the receiving terminals become connected to the feeding terminals upon the attachment of the electrode support frame to the case.

8. The ionizer according to claim 2, wherein the case is provided with a plurality of feeding terminals that is electrically connected to a high voltage source;

the electrode support frame is provided with a plurality of receiving terminals that is electrically connected to the discharge electrodes; and the receiving terminals become connected to the feeding terminals upon the attachment of the electrode support frame to the case.

9. The ionizer according to claim 1, comprising a plurality of pairs of discharge electrodes each of which is made up of a pair of discharge electrode that generate ion having polarities opposite to each other, wherein a distance from the tip of one of the two discharge electrodes in each pair of discharge electrodes to the center of the air hole is different from a distance from the tip of the other of the two discharge electrodes in each pair of discharge electrodes to the center of the air hole.

10. The ionizer according to claim 2, comprising a plurality of pairs of discharge electrodes each of which is made up of a pair of discharge electrodes that generate ion having polarities opposite to each other, wherein a distance from the tip of one of the two discharge electrodes in each pair of discharge electrodes to the center of the air hole is different from a distance from the tip of the other of the two discharge electrodes in each pair of discharge electrodes to the center of the air hole.

* * * * *